US005318093A

United States Patent [19]

MacDonald

[11] Patent Number: 5,318,093

[45] Date of Patent: Jun. 7, 1994

[54] METHOD AND APPARATUS FOR INVESTMENT CASTING

[76] Inventor: Charles H. MacDonald, 3343 Ridgewood Rd., Willits, Calif. 95490

[21] Appl. No.: 869,949

[22] Filed: Apr. 17, 1992

[51] Int. Cl.[5] ..... B22C 7/02

[52] U.S. Cl. ..... 164/35; 164/61; 164/65; 164/160.1; 164/376

[58] Field of Search ..... 164/34, 35, 36, 61, 164/65, 160.1, 253, 254, 255, 271, 349, 361, 376, DIG. 4; 249/61, 62

[56] References Cited

U.S. PATENT DOCUMENTS

| | | | |
|---|---|---|---|
| 1,244,257 | 10/1917 | Sweetnam | 164/DIG. 4 |
| 1,494,869 | 5/1924 | Sweetnam | 164/376 |
| 1,921,350 | 8/1933 | Custer . | |
| 2,171,778 | 9/1939 | Yantis | 164/DIG. 4 |
| 2,274,186 | 2/1942 | Brace | 164/DIG. 4 |
| 2,566,596 | 9/1951 | Cantor | 164/DIG. 4 |
| 2,653,361, | 9/1953 | Pellegrini . | |
| 3,610,317 | 10/1971 | Benfield et al. | 164/238 |
| 3,985,178 | 10/1976 | Cooper | 164/DIG. 4 |
| 4,962,909 | 10/1990 | Kohler | 164/DIG. 4 |

*Primary Examiner*—Paula A. Bradley
*Assistant Examiner*—Erik R. Puknys
*Attorney, Agent, or Firm*—Howard Cohen

[57] ABSTRACT

In an improved method and apparatus for investment casting, a pattern (31) is mounted on a sprue base (19) of an spider gasket (12) that is secured to one end of a standard investment flask (11). A solid end cap (13) is secured to the other end of the flask. The end cap is provided with a matrix of holes (15) extending therethrough parallel to the axis of the flask, and a plurality of small diameter rods (16) are slidable secured in the holes in the end cap. The rods are extended into the interior of the flask about the pattern without contacting the pattern. Investment plaster (10) is poured into the flask through the spider assembly to immerse the pattern and rods, and the plaster is allowed to set. The rods are then withdrawn, forming a large plurality of channels (32) extending into or through the investment plaster, reducing the amount of investment plaster required in the flask. The channels greatly accelerate the drying time of the investment, and hasten the subsequent burnout process in a kiln. The channels permit the escape of air from the cavity during casting, so that casting porosity is eliminated. Moreover, the channels formed by the rods are ideally placed for the strategic application of vacuum to the mold cavity during casting.

13 Claims, 4 Drawing Sheets

METHOD AND APPARATUS FOR INVESTMENT CASTING

FIELD OF THE INVENTION

This invention relates to casting of articles and objects, and particularly to an improved method and apparatus for investment casting.

BACKGROUND-DESCRIPTION OF THE PRIOR ART

Investment casting is a well-known and mature technology for precise replication of an existing object or model. Generally speaking an original wax model or a wax model made from an impression of an object is mounted on a sprue base extending from an end cap (gasket). A casting flask is secured to the gasket to form a container having an open upper end, and wet investment plaster is poured into the flask to a level above the model. The assembly is then set aside to dry and cure. Thereafter, the flask assembly is heated in an oven to drive off the wax and create the hollow casting mold cavity. A liquid casting material is then poured into the cavity through the sprue vent, and permitted to solidify to form an exact replica of the original model. In the case of molten metal casting, the molten metal is poured into the cavity while the investment is hot, so that the metal will fill all the mold voids and displace all the gas therefrom before it solidifies.

Production and transportation of investment plaster is costly, due to the energy intensive nature of investment plaster manufacturing and the density of the resulting product. Handling of dry investment plaster is a health and safety problem, as the fine particulate plaster poses a respiratory risk. Disposal of used investment is messy and ecologically wasteful, and has a negative environmental impact.

Porosity in cast parts is another shortcoming that occurs in investment casting. Porous parts are less strong, less aesthetic, and in many cases require additional finishing. Many porous parts are not usable at all.

A persistent problem in casting is that the investment plaster must be dry before being heated in the oven. When flasks containing investment that is still damp are placed into a kiln, the outside of the plaster cast heats and dries first, due to the fact that only the end surfaces of the flask assembly are exposed. The inner portion of the investment remains damp, while the drying of the outer end portions seals in the moisture. As the mold heats and the moisture turns to steam, the resulting internal steam pressure may cause the flask to explode. The mold is ruined, and a great deal of time and material is wasted. If the model is a primary wax pattern, the destruction of the original object represents a loss of many hours of highly skilled labor, and the original cannot be exactly duplicated.

Moreover, the investment casting process requires sufficient time to complete the steps of investment, drying, burnout, casting, and finishing. Often the process requires at least two days to complete, and this turnaround time for the flasks and models necessitates a large inventory of flasks, gaskets, and models for high volume, continuous production. The extensive time required to complete the entire process is problematic in terms of work schedules and delivery times. In addition, the prodigious amount of energy consumed in running a kiln, especially at its highest temperatures, is expensive and causes deterioration of the kiln element and lining.

SUMMARY OF THE PRESENT INVENTION

The present invention generally comprises an improved method and apparatus for investment casting. Salient features of the invention are that the investment casting process is accomplished in far less time than prior art techniques, while using less kiln time and less investment plaster. Shorter burnout cycles in the kiln, with proportionately less time running at higher temperatures, speeds production, saves energy, saves time and money, and extends kiln life. Use of less investment per finished part is clearly advantageous in saving material cost and diminishing the problem of disposal of used investment. The invention also consistently produces castings of higher quality with less porosity than prior art techniques and apparatus. The method is also complementary to such ancillary techniques as vacuum casting and centrifugal casting.

In accordance with the invention, an original object, pattern, or model is provided and mounted on a sprue base. An end cap having an open spider structure is used to support the sprue base and model, and is secured to one end of a standard investment flask. A solid end cap is secured to the other end of the flask. The end cap is provided with a matrix of holes extending therethrough parallel to the axis of the flask, and a plurality of small diameter rods are slidable secured in the holes in the end cap. The rods are extended into the interior of the flask under visual guidance of the operator looking through the spider assembly. The rods are extended about the model without contacting the model. Thereafter, investment plaster is poured into the flask through the spider assembly, and the plaster is allowed to set. The rods are then withdrawn, forming a large plurality of channels extending through the investment plaster parallel to the axis of the flask. It should be noted that the displacement volume of the rods reduces the amount of investment plaster required in the flask.

The channels greatly accelerate the drying time of the investment, due to the increased surface area exposed to air, so that the mold can be placed in the kiln much sooner than has been possible with previous techniques. The burnout process in the kiln is also greatly hastened by the channels in the investment mold, also due to the increased surface area exposed to the heated air of the kiln. Furthermore, the channels permit the escape of air from the cavity during casting, so that casting porosity is eliminated.

Moreover, the channels formed by the rods are ideally placed for the general and strategic application of vacuum to the mold cavity during casting. The adjustable placement of the pins and their consequent fine tuning of the vacuum pressure and/or centrifugal resistance of the investment plaster facilitates reliable casting of patterns that are now difficult or impossible to fill. The closer pins are placed to the mold cavity, the less plaster there is for a vacuum to pull through, and hence the stronger the vacuum pressure applied to the mold cavity. Conversely, areas of the flask that are distant from the mold cavity can have pins set further back, so that in relation to the areas closely adjacent to the mold cavity, those distant areas exhibit more resistance to air flow under vacuum pressure because of a greater thickness of plaster left at the ends of the rods and the channels they subsequently form. As a result, vacuum pressure can be directed to portions of the mold cavity where it is most needed, so that difficult patterns can be cast reliably.

The air channels in the investment are produced without the creation of any noxious fumes from the burnout of was or plastic.

The apparatus can be easily manufactured from inexpensive materials using widely available machinery and technologies. Production, transportation, and inventory and sale of the device presents very few technical or marketing problems. It is small, light, and directly adaptable to all standard equipment commonly used in centrifugal and vacuum investment casting throughout the jewelry, dental, firearms, automotive, and aerospace industries.

The end cap, rods, and spider assembly are all reusable indefinitely, so that the method is accomplished without the consumption of additional materials or additional expense.

Further objects and advantages of my invention will become apparent from a consideration of the drawings and ensuing description of it.

DESCRIPTION OF THE APPARATUS

Figure 1:
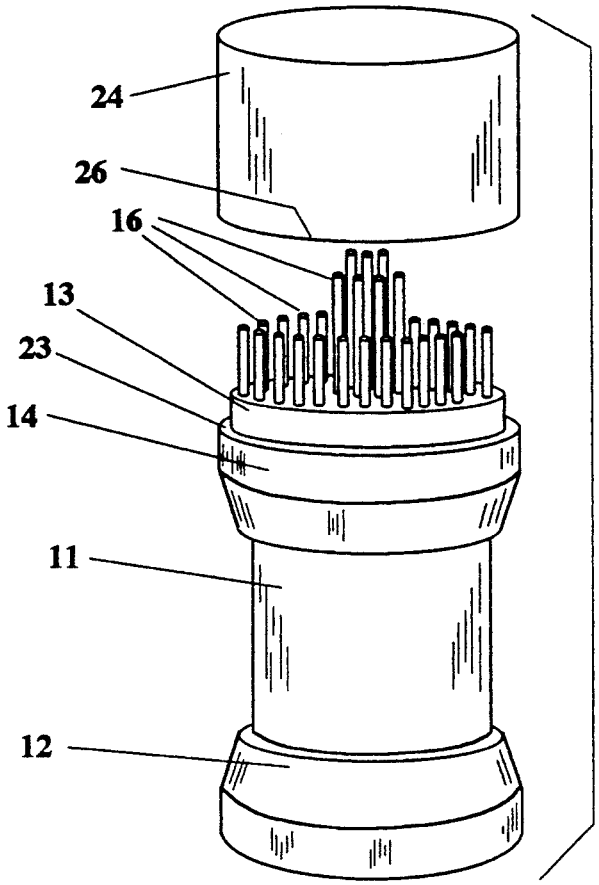
FIG. 1 is a perspective view of one embodiment of an investment casting assembly of the present invention.

The present invention generally comprises an improved method and apparatus for investment casting. With regard to FIGS. 1 and 2, the apparatus of the invention includes a casting flask 11, comprising a cylindrical, tubular member known in the prior art and readily available in a variety of standard sizes. Secured to one end of the flask is a spider gasket 12, while a sealing gasket 14 is secured to the other end of the flask. A cylindrical boss 13 extends axially outwardly from the sealing gasket 14, defining therewith a flange 23 extending circumferentially about the gasket 14.

Figure 2:
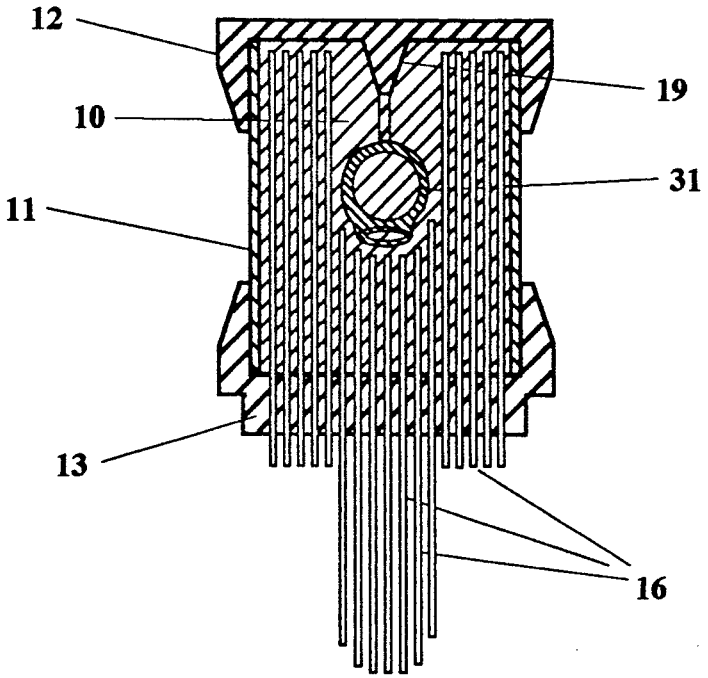
FIG. 2 is a cross-sectional elevation of the investment casting assembly depicted in FIG. 1.
Figure 3:
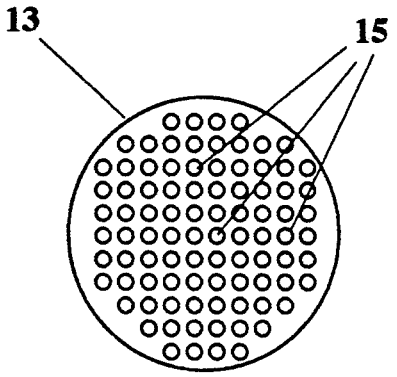
FIG. 3 is a plan view of the end cap of the present invention.
Figure 4:
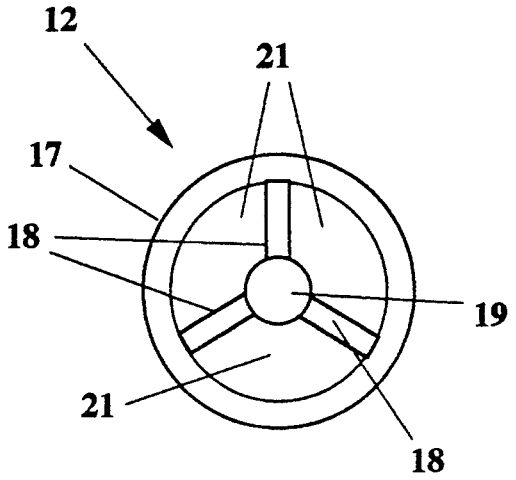
FIG. 4 is a plan view of the spider end cap of the present invention.

With regard to FIGS. 1–3, the boss 13 includes a plurality of holes 15 extending therethrough parallel to the axis of the cylinder. As shown in FIG. 4, the spider gasket 12 comprises an annular rim 17 having an inner diameter dimensioned to receive the outer surface of the flask 11 in compressive engagement. A plurality of arms 18 extend generally radially from the rim 17 toward the center thereof, and are joined to a central sprue base 19. The arms 18 support the sprue base 19, and also define openings 21 which provide access to the interior of the flask assembly, both for visualization and for the addition of investment plaster to the assembly, as will be explained in the following description.

A salient feature of the apparatus is the provision of a plurality of displacement rods 16, as shown in FIGS. 1 and 2. The rods 16 comprise form-retaining, narrow, elongated members formed of metal, plastic, or rubber material, and are dimensioned to be received in the holes 15 of the boss 13 in a frictional fit that retains the rods, yet permits slidable translation of the rods by manual force. The rods may all be of uniform length, or may be graduated in length in accordance with the position of the hole 15 in which each is received.

The apparatus also includes a vacuum collar 24, comprising a cup-like cylindrical member having an open end 26 that is dimensioned to be received about the boss 13 in contact with the flange 23. During vacuuming of the flask assembly inside the bell jar common in the prior art the irregularly protruding pins are collectively surrounded by the vacuum collar 24, the end of which extends past the maximally protruding pins. This cylindrical stand arrangement holds flask upright preventing tipping and spilling of the liquid investment during vacuuming or vibrating of the flask assembly. Vacuum collar 24 could be molded as an integral part of the sealing gasket 14 to provide a means to accomplish the same goal.

DESCRIPTION OF THE METHOD

The method of the present invention using the components described above involves first creating or obtaining a wax pattern 31 (original or replica), and mounting the pattern on the sprue base 19 of the spider gasket, as shown in FIG. 2. The spider gasket 12 is then assembled to one end of the investment flask 11. Thereafter, the sealing gasket 14 is secured to the other end of the investment flask 11, and the displacement rods 16 are extended from the boss 13 into the interior chamber of the flask 11. (The rods may be prepared by the application of a mold release compound.) The rods 16 are advanced under visual guidance by the operator looking through the openings 21 in the spider gasket 12, so that the rods extend only to a minimum clearance with the wax pattern. This step is accomplished with the spider gasket 12 disposed uppermost, as shown in FIG. 2.

Figure 5:
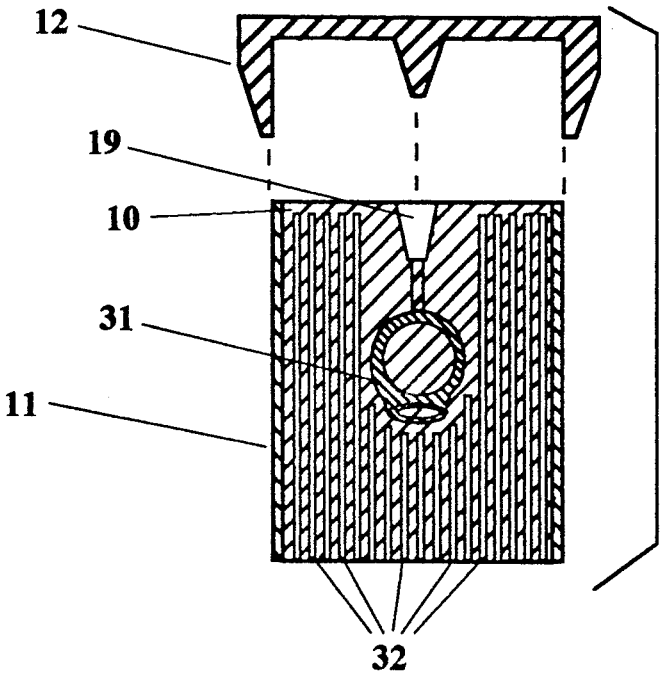
FIG. 5 is a cross-sectional elevation of a plaster cast formed in accordance with the present invention in the drying stage.

Thereafter, investment plaster 10 in liquid form is added to the interior of the investment flask 11 by pouring the plaster through the openings 21 of the spider gasket. This step is performed in a disposition of the flask assembly that is inverted with respect to prior art techniques. Under visual guidance, sufficient plaster is added to immerse the wax pattern and a portion of the sprue base, as shown in FIG. 2. The investment plaster is allowed to set up sufficiently to be form-retaining, and the rods 16 are removed from the investment plaster. This step may be accomplished by pulling individual rods out of the boss 13. The result is a plaster cast having a plurality of channels 32 extending longitudinally therethrough, as well as the wax pattern and sprue, contained in the investment flask, as shown in FIG. 5.

The plaster cast is then permitted to dry thoroughly. This step is aided greatly by the presence of the channels 32, which displace a significant volume of plaster and reduce the total mass of plaster that must undergo the drying process. The channels also provide a large surface area exposed to ambient air, hastening the removal of water from the plaster. Dry air may be blown through the channels to accelerate the drying process.

Figure 6:
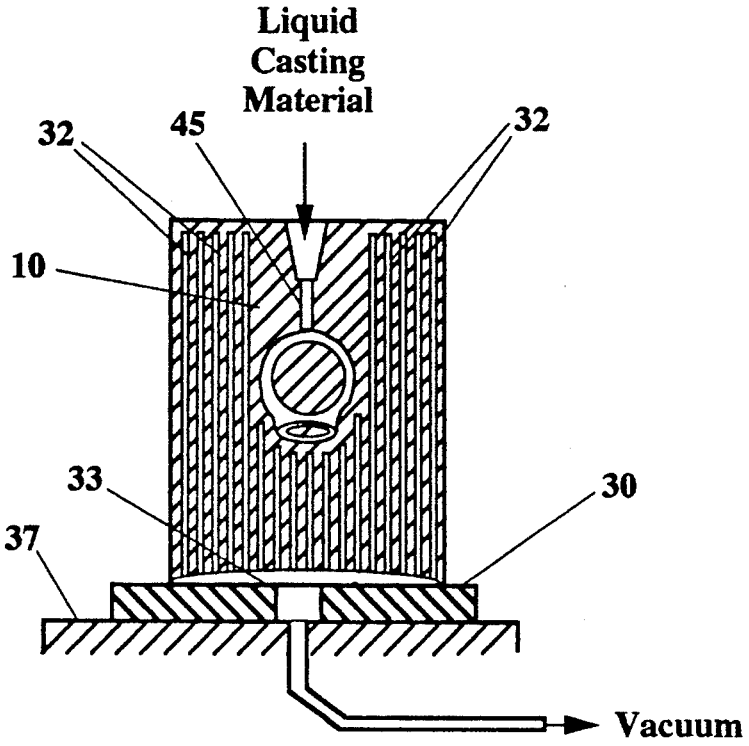
FIG. 6 is a schematic view of the investment mold of the present invention used in a vacuum casting arrangement.

When the plaster is sufficiently dry, the plaster mold is placed in a kiln and heated to a temperature sufficient to drive off the wax that forms the pattern and sprue channel. The plaster mold is then removed from the kiln and molten metal is poured or injected into the sprue channel to fill the mold cavity while the plaster mold is hot (FIG. 6). The mold is permitted to cool, the plaster mold is opened to gain access to the casting, and the casting is finished to form the completed object.

With regard to FIG. 6, the casting step may be enhanced by applying vacuum pressure to the investment mold while casting takes place. A vacuum table 37 (known in the prior art) is provided with a high temperature silicone gasket or pad 30, through which a vacuum port 33 extends to a vacuum pump. The completed investment mold 35 comprises a cylindrical plaster object having a plurality of channels 32 extending longitudinally therethrough, and a hollow mold cavity 40 disposed among the channels 32. A sprue channel 45 extends from the upper end of the mold 35 to the mold cavity 40. The mold 35 may have the lower end surface 50 formed in concave fashion by the artisan, so that the lower end of the flask 11 forms a good seal with the silicone pad 30.

The heated mold 35 is placed on the pad 30, and vacuum pressure is applied to the channels to draw gases out of the mold spaces while the liquid casting material, such as molten metal, is poured into the sprue channel 45 and the mold cavity 40. It may be appreciated that the channels 32 that are radially spaced farthest apart from the mold cavity 40 may be fashioned shorter than the channels that closely approach the mold cavity, to assure that the vacuum pressure is not dissipated by the induction of ambient air directly through the open or thinly shrouded channels that extend through the plaster cast. That is, the vacuum pressure is directed toward the mold cavity to enhance the reduction in casting porosity.

If the plaster cast is to be used in a centrifugal casting machine, the channels not directly adjacent to the mold cavity may be fashioned to extend completely through the plaster cast. This arrangement permits ambient air to flow through the open channels and hasten the drying process.

Figure 7:
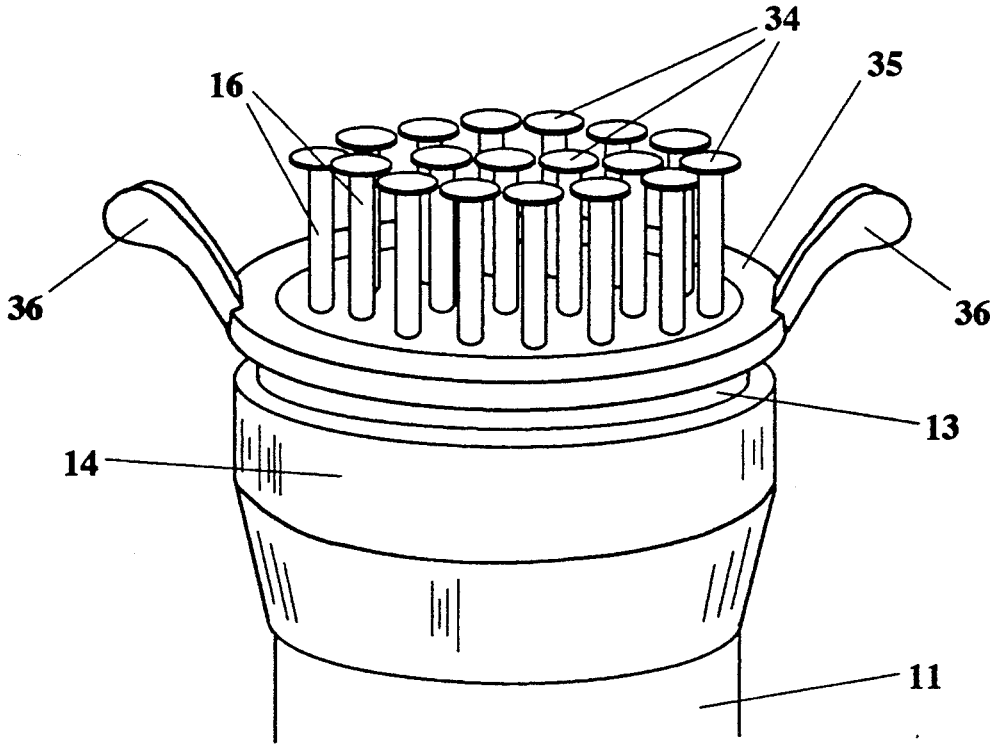
FIG. 7 is a perspective view of a further embodiment of the end cap of the present invention.

A further embodiment of the invention, shown in FIG. 7, provides a convenient and efficient means to remove the rods 16 from the investment plaster after the plaster has set up. The rods 16 are each provided with a head or flange 34 disposed at the outer end thereof, and the rods 16 extend slidably through a matrix of holes in a plate 35. The plate 35 includes handles 36 that facilitate grasping and pulling the plate 35 outwardly from the boss 13. The plate 35 impinges on the flanges 34 of the rods and cause the rods to be pulled from the plaster cast. This may be accomplished in one step, rather than removing each of the rods 16 individually from the flask. The end cap may also be removed by mechanical means, such as a toggle arm, screw jack or power-assisted pneumatic or hydraulic means, as are known in the art.

Figure 8:
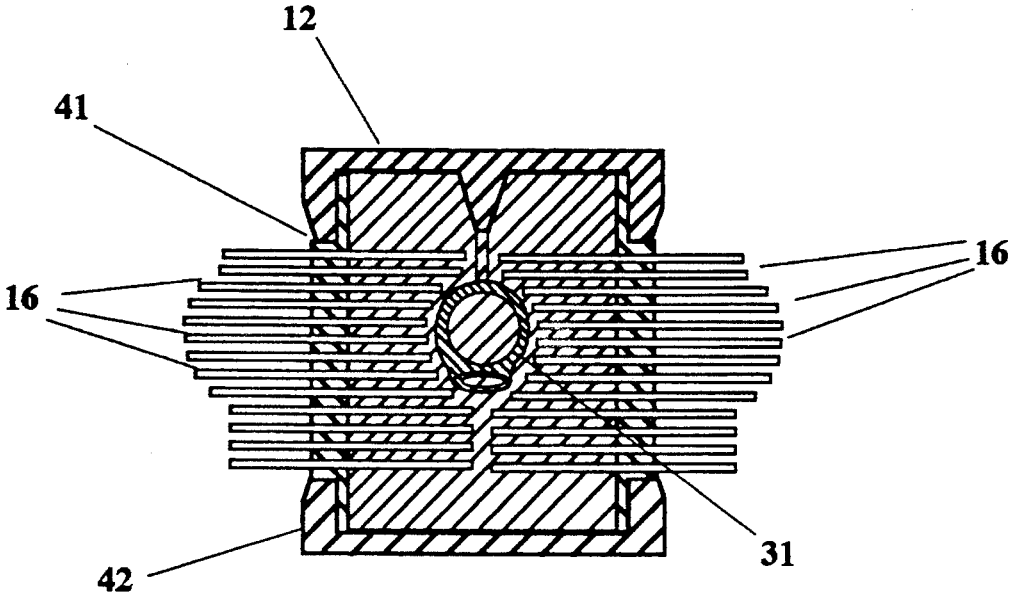
FIG. 8 is a cross-sectional elevation of a further embodiment of the investment casting assembly of the present invention.

In an alternative embodiment of the invention, depicted in FIG. 8, the flask 11 includes a medial sidewall portion 41 that is substantially thicker than the remainder of the sidewall. The portion 41 includes a plurality of holes therein extending generally radially with respect to the axis of the assembly, and a like plurality of displacement rods 16 are slidably received in the holes in the sleeve. One end of the investment flask 11 is secured to a spider gasket assembly 12, as described previously, while the other end of the flask is closed by the integral end wall 42 of the flask 11.

The rods 16 are employed as described previously: prior to adding the investment plaster to the flask, the rods are translated inwardly toward the center of the flask, with minimum clearance maintained from the wax pattern. After the plaster is poured in through the spider gasket holes 21 and allowed to set, the rods 16 are withdrawn from the flask 11. Thereafter, the process proceeds as described above: the plaster cast is dried, fired in a kiln to drive off the wax in the pattern, and liquid casting material is poured into the mold cavity. The embodiment of FIG. 8 has the advantage of creating channels 32 that surround the wax pattern more uniformly than the previous embodiment.

Figure 9:
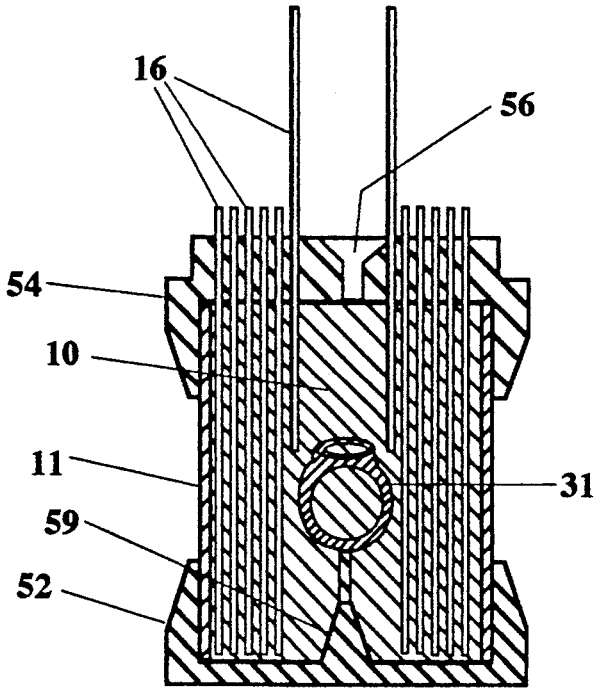
FIG. 9 is a cross-sectional elevation of another embodiment of the investment casting assembly of the present invention.

With regard to FIG. 9, a further embodiment of the apparatus includes an investment flask 11 as described previously, and a standard sprue base 52 secured to and sealing one end of the flask. The sprue base 52 includes a sprue former 59 which supports a wax pattern 31 within the flask. An upper end gasket 54 is removably secured to the upper end of the flask 11, and includes a hole 56 for pouring investment plaster 10 into the flask. The gasket 54 also includes a matrix of holes which receive a plurality of displacement rods 16 in slidable fashion. The rods 16 are employed as described previously, and the hole 56 is used for visual access for positioning the rods. This embodiment permits the technician to use the flask in a familiar mode, with the standard sprue base disposed at the bottom and the investment plaster poured into the top of the flask. Also, this arrangement obviates the need for a separate spider cap, as described previously, and there is no need for a collar or fixture to hold the flask "upside down" during the steps of vibrating or vacuuming the investment after filling the flask.

In the embodiments described above, the rods 16 are depicted as oriented generally orthogonally to the end cap 13 or generally radially to the flask sidewall. However, the rods 16 may be oriented at any angle which is advantageous with respect to the wax pattern and sprue pattern. Also, the rods 16 are depicted as being generally uniform in length. However, the rods may differ in length either randomly or uniformly without departing from the spirit and essence of the invention. Furthermore, the rods 16 may be formed in a manner which facilitates their release and removal from the plaster cast. For example, each rod may comprise an inflatable member connected to a source of hydraulic or pneumatic pressure, so that the pressure causes each rod to assume its displacement volume. After the plaster is set, the pressure is removed from each rod, and the deflated rods are easily withdrawn from the channels 32. The rods may also be formed as telescoping assemblies, in which case the use of hydraulic or pneumatic pressure will also aid in the extension and withdrawal of the rods in the investment flask.

In any of the embodiments described herein, the casting material may comprise compounds other than molten metal. For example, thermoplastic or thermosetting compounds, epoxy resins, powders, or any other compounds, substances, mixtures, or elements that can flow and subsequently harden may be employed with the present invention. Moreover, although the investment material is described as plaster, any mold forming material known in the prior art may be used with the present invention. For example, small ferrous particles may be vibrated or compressed or vacuumed to minimize interstitial space, and frozen in place with an electromagnet. Another example is powders bonded in place by a temporary, reversible sintering process accomplished by heat, cold, chemical reaction, or the like.

Thus it may be seen that I have provided an investment casting process and apparatus which have the following advantages:

1) The mass of investment plaster is significantly reduced, saving material and material cost and reducing negative environmental impact.

2) The channels formed by the rods in the plaster increase the exposed surface area of the plaster, accelerating the drying process.

3) The heating cycle in the kiln to drive off the wax is shortened by the decreased mass of investment plaster, especially in the most energy wasteful heat-soaking phase, saving time and energy and extending kiln life.

4) The channels formed by the rods in the plaster are optimal passages for the general and strategic application of vacuum pressure during the step of pouring casting material into the mold cavity. The same advantages apply equally to centrifugal casting.

5) The quality of finished castings is improved due to porosity reduction produced by air channels using either vacuum or centrifugal casting.

6) The time required to complete the overall investment casting process is significantly reduced, making more efficient use of manpower and allowing casting components to be reused more rapidly; and the ratio of the value of the parts produced per unit time compared to the capital cost of the casting components (productivity) is increased;

7) The casting components of the apparatus (with the exception of the pattern and investment plaster) are reusable indefinitely.

While the description above of the process and apparatus contains many specificities, these should not be construed as limitations on the scope of the invention, but rather as an exemplification of one preferred embodiment thereof. Many other variations are possible without departing from the invention.

For example, rods may be addressable and inserted and retracted by numerical machine or computer control, or alternatively by sensors in the rods which position the rods according to preset distances from objects (pattern or sprue base). Also, the end gasket(s) may include fixed rods molded in various general configurations determined to be commonly useful. These fixed rod bases are useful in long production runs of identical or similar parts.

The rods may also be preset before affixing the spider gasket and end gasket to the flask by means of a solid, non-fragile form molded to closely conform to the contours of the wax model and sprues with clearance to produce the sheath of plaster necessary immediately surrounding the wax model. The non-fragile form may be pressed directly against the ends of the rods to produce the desired arrangement of rods. This form may be either a positive or negative shape, depending on which ends of the rods it is more convenient to engage. This form may serve to minimize operator error in the manual setting of rods, and it is useful in production runs of similar castings.

The mold cavity-forming pattern has been described herein as fabricated of wax, which is common in the prior art. However, any substance which is meltable, volatilizable, evacuable, or otherwise removable from the hardened investment without altering the mold cavity formed by the pattern may be used. For example, plastic or resin compounds, objects comprising organic substances (e.g., wood, lifeforms, insects, etc.) may be used as patterns without departing from the scope of the invention.

I claim:

1. An apparatus for improved investment casting, including; an investment flask; means for supporting a casting pattern in said flask; means for retaining a mass of liquid investment material within said flask; a plurality of displacement rods extendable into said flask for reducing the volume of liquid investment material required to fill said investment flask sufficiently to form an investment mold cavity from said casting pattern; said means for retaining a mass of liquid investment material including an end cap removably secured to a first end of said flask; said end cap including a plurality of holes extending therethrough from an outer surface thereof to the interior of said investment flask; each of said displacement rods having the capability of being slidably disposed within a respective one of said holes and translatable into said interior of said investment flask during and after pouring the investment material.

2. The apparatus of claim 1 wherein said means for supporting a casting pattern in said flask comprises spider gasket means having openings permitting visual inspection of said displacement rods.

3. The apparatus of claim 1 wherein said end cap has an opening permitting visual inspection of said displacement rods.

4. The apparatus of claim 1 wherein said plurality of holes are arranged in an ordered pattern.

5. The apparatus of claim 4 wherein said ordered pattern comprises rows and columns.

6. An investment mold, comprising a molding pattern immersed in a volume of investment plaster, and a plurality of hollow channel means extending into said volume of investment plaster to decrease the mass of investment plaster and increase the exposed surface area of said volume of investment plaster, and spider gasket means for supporting said molding pattern in said volume of investment plaster.

7. The investment mold of claim 6, wherein said hollow channel means includes a plurality of hollow channels extending from the exterior of said volume of investment plaster, some of said hollow channels extending adjacent to said molding pattern.

8. The investment mold of claim 6, further including an investment flask for supporting and containing said volume of investment plaster.

9. An improved method for investment casting, comprising the steps of: providing a casting flask having an interior chamber, supporting a casting mold pattern in said interior chamber, providing an end cap on an end portion of said flask with said end cap having a plurality of holes extending therethrough from an outer surface thereof to the interior of said flask, inserting a plurality of displacement rods through said holes in said end cap into said interior chamber, pouring flowable investment molding material into said interior chamber to immerse said casting mold pattern, each of said displacement rods having the capability of being slidably disposed within a respective one of said holes and translatable into the interior of said flask during and after pouring the investment material, setting said molding material to create a form-retaining solid with said casting pattern and said displacement rods embedded therein, removing said displacement rods to form a plurality of channels in said molding material, drying said molding material, heating said mold material and said casting pattern therein to a temperature sufficient to evacuate said casting pattern and form a mold cavity, and pouring a flowable casting material into said mold cavity.

10. The improved method for investment casting of claim 9, further including the step of applying vacuum pressure to said channels during the step of pouring a flowable casting material into said mold cavity.

11. The improved method for investment casting of claim 9, wherein the step of pouring a flowable casting material into said mold cavity further includes the step of applying vacuum pressure to preselected channels to apply vacuum pressure strategically to said mold cavity and enhance flow of said casting material in said mold cavity.

12. The improved method for investment casting of claim 9, wherein said step of pouring a flowable casting material comprises pouring molten metal into said mold cavity.

13. The improved method for investment casting of claim 9, wherein said step of drying said molding material includes the step of applying vacuum pressure to said channels to remove moisture from said investment molding material.

* * * * *